US010280710B2

(12) United States Patent
Minassa

(10) Patent No.: US 10,280,710 B2
(45) Date of Patent: May 7, 2019

(54) AUTO-SHUT-IN CHEMICAL INJECTION VALVE

(71) Applicant: Halliburton Energy Services, Inc., Houston, TX (US)

(72) Inventor: Lorenzzo Breda Minassa, Tomball, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 88 days.

(21) Appl. No.: 15/521,248

(22) PCT Filed: Oct. 12, 2015

(86) PCT No.: PCT/US2015/055058

§ 371 (c)(1),
(2) Date: Apr. 21, 2017

(87) PCT Pub. No.: WO2017/065720

PCT Pub. Date: Apr. 20, 2017

(65) Prior Publication Data

US 2018/0298725 A1 Oct. 18, 2018

(51) Int. Cl.
*E21B 34/10* (2006.01)
*E21B 43/16* (2006.01)

(52) U.S. Cl.
CPC ..... *E21B 34/10* (2013.01); *E21B 34/101* (2013.01); *E21B 43/162* (2013.01)

(58) Field of Classification Search
CPC ..... E21B 34/10
See application file for complete search history.

(56) References Cited

U.S. PATENT DOCUMENTS 6,659,184 B1 * 12/2003 Tips ..... E21B 34/10 166/320
9,447,658 B2 * 9/2016 He ..... E21B 37/06
2003/0048197 A1 * 3/2003 Purkis ..... E21B 23/04 340/853.1

(Continued)

FOREIGN PATENT DOCUMENTS

WO WO-2014077814 A1 5/2014
WO WO-2015065313 A1 5/2015

OTHER PUBLICATIONS

Korean Intellectual Property Office, International Search Report and Written Opinion, dated Jul. 12, 2016, 16 pages, Korea.

*Primary Examiner* — Blake E Michener

(57) ABSTRACT

An auto-shut-in valve in a chemical injection valve is described for operation at a downhole location in a wellbore. The chemical injection valve includes a closure member that is maintained in an open position by fluid pressure in a chemical supply line such that diminishment of the fluid pressure in the chemical supply line automatically causes the closure member to move to a closed position. A first mating surface on the closure member is exposed to the fluid pressure in the chemical supply line when the closure member is in the open position, and defines a portion of an equivalent differential surface to which the fluid pressure is exposed to maintain the closure member in the open position. The first mating surface is isolated from the fluid pressure in the chemical supply line when the closure member is in the closed position.

19 Claims, 6 Drawing Sheets

(56) References Cited

U.S. PATENT DOCUMENTS

| | | | | |
|---|---|---|---|---|
| 2003/0230190 | A1* | 12/2003 | Douglas | E21B 34/10 91/454 |
| 2004/0040718 | A1* | 3/2004 | Rhodes | E21B 34/08 166/325 |
| 2009/0014168 | A1* | 1/2009 | Tips | E21B 33/14 166/73 |
| 2010/0051289 | A1* | 3/2010 | Constantine | E21B 34/10 166/373 |
| 2011/0067876 | A1 | 3/2011 | Turner et al. | |
| 2011/0079398 | A1 | 4/2011 | Patel et al. | |
| 2012/0125628 | A1* | 5/2012 | Reid | E21B 23/006 166/373 |
| 2012/0318367 | A1* | 12/2012 | Going | G01F 11/021 137/12 |
| 2013/0048303 | A1* | 2/2013 | Patel | E21B 34/10 166/373 |
| 2015/0292301 | A1* | 10/2015 | Minassa | E21B 34/06 166/222 |

* cited by examiner

AUTO-SHUT-IN CHEMICAL INJECTION VALVE

BACKGROUND

1. Field of the Invention

The present disclosure relates generally to downhole tools useful in operations related to oil and gas exploration, drilling and production. More particularly, embodiments of the disclosure relate to a chemical injection valve operable to automatically move to a closed configuration before the hydrostatic pressure in a chemical supply line may be diminished.

2. Background

In operations related to the production of hydrocarbons from subterranean geologic formations, chemical management can be important in optimizing fluid productions as well as minimizing well downtime and expensive intervention. For example, chemicals may be injected into various locations of a wellbore to inhibit certain processes like corrosion or the accumulation of scale. Also, certain chemicals may be introduced into a wellbore to treat the production fluids to alter their chemical properties in the downhole environment, e.g., to reduce viscosity or other fluid characteristic.

In a typical chemical injection installation, a chemical injection mandrel is interconnected into a production tubing string and includes an injection port positioned at the desired location. For example, the injection port may be positioned to permit flow into an interior of the tubing string at a particular depth, or alternatively, the injection port may be positioned to permit flow into down-hole locations exterior to the tubing string. One or more chemicals may be supplied to the chemical injection mandrel through a chemical supply line that extends from a chemical pumping unit disposed at a surface location. Various control and communication lines may also extend between the mandrel and surface control equipment to facilitate operation of down-hole components on the mandrel. A check valve may be positioned between the chemical supply line and injection port to discourage wellbore fluids, such as production gas oil or water from migrating into the chemical injection system upstream of the check valve.

Also, it is common for sacrificial rupture discs to be provided within the chemical supply line upstream of the injection port to permit pressure testing of the chemical supply line prior to operation. The rupture discs may be rated to withstand pressures of the desired testing, and may be ruptured to permit fluid flow to the injection port once the testing is complete.

It has been found that in various instances, a chemical injection pressure maintained by the chemical pumping unit in the chemical supply line may be inadvertently diminished. For example, depletion of the production fluids from a wellbore interval may affect the ability to maintain the hydrostatic pressure, or alternatively failure of the chemical pumping unit may result in an uncontrolled draining of the chemicals in the chemical supply line through the injection port. The diminishment of hydrostatic pressure may cause hydrates to form that can plug the chemical supply lines.

BRIEF DESCRIPTION OF THE DRAWINGS

The disclosure is described in detail hereinafter on the basis of embodiments represented in the accompanying figures, in which.

DETAILED DESCRIPTION

In the following description, even though a Figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a Figure may depict an offshore operation, it should be understood by those skilled in the art that the apparatus according to the present disclosure is equally well suited for use in onshore or terrestrial operations. Further, unless otherwise noted, even though a Figure may depict a wellbore that is partially cased, it should be understood by those skilled in the art that the apparatus according to the present disclosure may be equally well suited for use in fully open-hole wellbores.

1. Description of Exemplary Embodiments

The present disclosure includes chemical injection systems including an auto-shut-in chemical injection valve in a chemical supply line. The auto-shut-in chemical injection valve is automatically responsive to the diminishment of the chemical injection pressure in the chemical supply line to move to a closed configuration, and thereby maintain a supply of chemicals in the chemical supply line. In some instances, a predetermined threshold pressure at which the chemical injection valve moves to the closed position is above a hydrostatic pressure of the chemical supply line, which may be generally defined by the weight of a column of chemicals extending to a surface installation. The auto-shut-in chemical injection valve also permits testing of the chemical supply line without the use of sacrificial burst discs. Thus, multiple tests may be carried out on the chemical supply line even after the chemical supply line has been used to inject chemicals into a wellbore.

Figure 1:
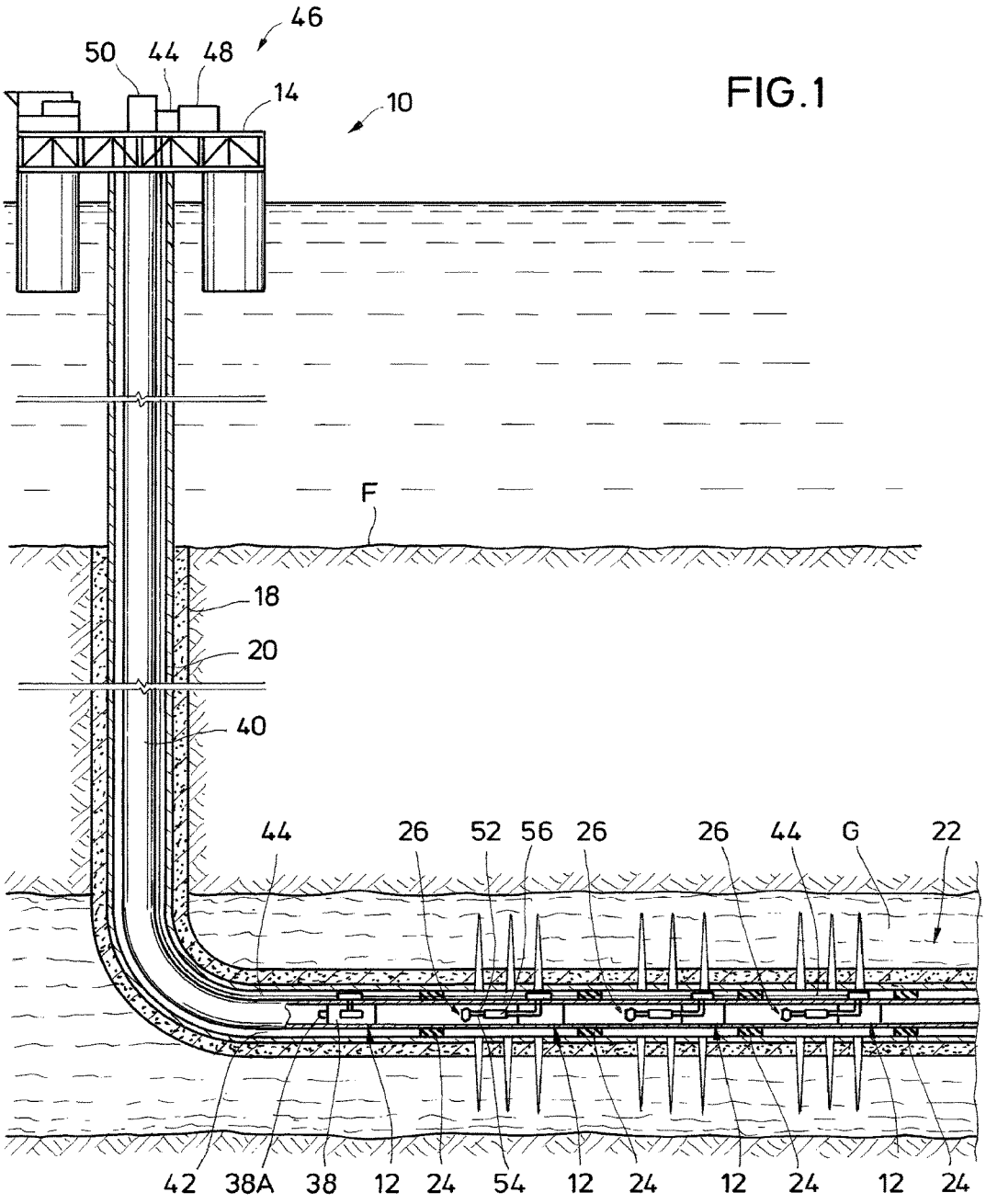
FIG. 1 is a partially cross-sectional side view of a downhole chemical injection system including a plurality of auto-shut-in chemical injection valves in operation on an offshore platform in accordance with one or more exemplary embodiments of the disclosure.

FIG. 1 is a partially cross-sectional side view of a down-hole chemical injection system 10 including a plurality of auto-shut-in chemical injection valves 12 in accordance with one or more exemplary embodiments of the disclosure. In other embodiments, a single chemical injection valve 12 may be provided. The chemical injection system 10 is illustrated in operation on a semi-submersible offshore platform 14. The offshore platform 14 is disposed over a hydrocarbon bearing geologic formation "G" located below sea floor "F." A wellbore 18 extends through the various earth strata geologic formation G, and includes a casing string 20 cemented therein. Disposed in a substantially horizontal portion of wellbore 18 is a completion assembly 22 that includes various tools such as packers 24 and interval control valves (ICVs) 26. In this example embodiment, a chemical injection valve 12 is positioned below each ICV 26 and may be operably associated with the ICV 26 as described below. In other embodiments, a chemical injection valve 12 may be provided above each packer 24, or at other locations within the completion assembly 22. In this example embodiment, an additional chemical injection valve 12 is positioned above an uppermost packer 24, and may or may not be operably associated with any of the ICVs 26.

Each chemical injection valve 12 is installed in or on a chemical injection mandrel 38 coupled within a tubing string 40. The tubing string 40 is a production tubing string and generally provides a conduit for the production of formation fluids, such as oil and gas, to a surface location. An annulus 42 is defined about the tubing string 40 between the tubing string 40 and the geologic formation "G" and/or the casing string 20. The chemical injection mandrel 38 may include an injection port 38A through which treatment chemicals may be directed to an interior of the tubing string 40, or to another downhole location, after passing through the auto-shut-in chemical injection valve 12.

In the illustrated embodiment, a separate chemical supply line 44 extends between a surface installation 46 and each of the individual auto-shut-in chemical injection valves 12. Thus, separate chemicals may be injected through each of the chemical supply lines 44 to different portions of the completion assembly 22. The surface installation 46 includes a treatment fluid pump 48 coupled to one or more of the chemical supply lines 44 to pump treatment chemicals into the chemical supply lines 44. The chemical supply lines 44 pass through a wellhead 50 and may be employed to deliver the treatment chemicals from the pump 48 to the chemical injection mandrels 38 through the auto-shut-in chemical injection valves 12. The treatment chemicals may include, for example, chemicals employed in applications such as defoaming, corrosion prevention and/or the treatment of scale, hydrates, paraffin and the like.

In some exemplary embodiments, one or more control lines 52, 54 are provided to operably couple an auto-shut-in chemical injection valve 12 with one or more of the ICVs 26 via a controller 56. The controller 56 may be positioned at any location including the surface installation 46, the auto-shut-in-valve 12, and/or the ICV 26. In some embodiments the controller 56 may be an ICV controller and/or a splice manifold operable to split control signals between the ICV 26 and the chemical injection valve 12. As described in greater detail below, the control line 52 may be employed to open the ICV 26 with a single control signal that also opens the auto-shut-in chemical injection valve 12. Similarly, the control line 54 may be employed to close the ICV 26 with a single control signal that also closes the chemical injection valve 12.

Figure 2A:
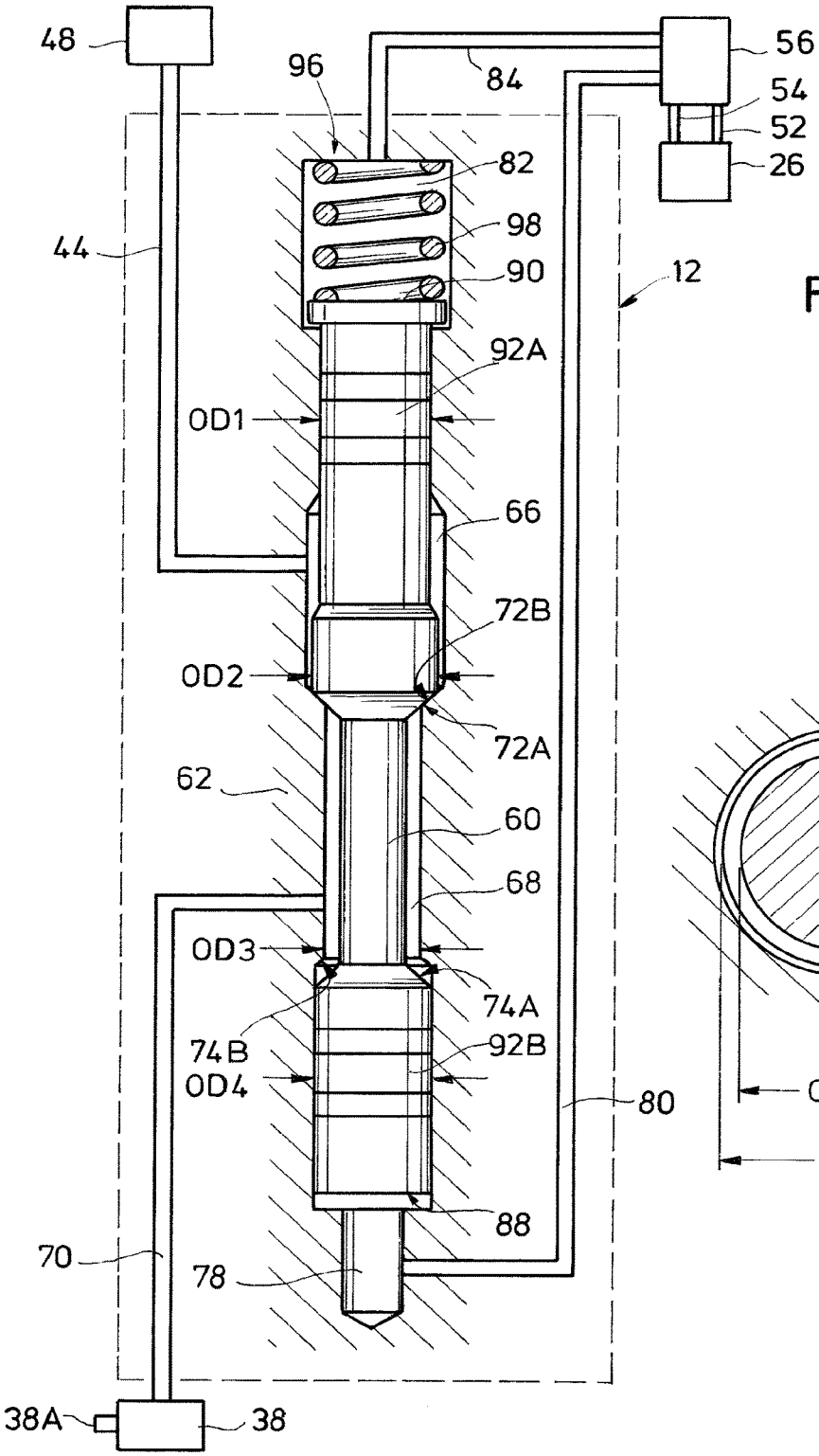
FIG. 2A is a partially cross-sectional side view of the auto-shut-in chemical injection valve of FIG. 1 in a closed configuration.

FIG. 2A is a partially cross-sectional side view of the auto-shut-in chemical injection valve 12 in a closed configuration. The chemical injection valve 12 generally includes a closure member 60 disposed within a manifold or housing 62. The housing 62 may be coupled to the chemical injection mandrel 38, or may be constructed as part of the chemical injection mandrel 38 such that the various components of the chemical injection valve 12 may be installed to the mandrel 38 as a single unit. The housing 62 defines an inlet chamber 66 fluidly coupled to the chemical supply line 44 and an outlet chamber 68 fluidly coupled to an output flow line 70 that extends to the chemical injection mandrel 38. The closure member 60 includes a first mating surface 72A thereon for engaging a corresponding first mating surface 72B on the housing 62 to establish a primary seal of the chemical injection valve 12 and prevent fluid communication between the inlet chamber 66 and the outlet chamber 68 when the auto-shut-in chemical injection valve 12 is in the closed configuration. Where the first mating surfaces 72A, 72B are engaged with one another, the closure member 60 may be described as being disposed in a closed position within the housing 62. Within the outlet chamber 68, the closure member 60 includes a second mating surface 74A thereon for engaging a corresponding second mating surface 74B on the housing 62. The second mating surfaces 74A, 74B are spaced from one another when the auto-shut-in chemical injection valve 12 is in the closed configuration.

The housing 62 also defines an open control chamber 78 fluidly coupled to an open control line 80 and a close control chamber 82 fluidly coupled to a close control line 84. The open control line 80 and the close control line 84 extend to the controller 56. As indicated above, the controller 56 may be operable to provide a control signal through the open control line 80 and the close control line 84 to move the closure member 60 between respective open and closed positions in the housing 62. As indicated above, the controller 56 may be disposed at a down-hole location near the ICV 26, or in some embodiments, the controller 56 may be included in the surface installation 46 (FIG. 1). The controller 56 may comprise a pump or another source of a pressurized working fluid (not shown) selectively operable to provide the pressurized working fluid to the control lines 52, 54, 80, 84 coupled thereto. In some embodiments, the controller 56 can comprise a computer (not shown) operable to receive instructions from an operator or from other system components, and to cause the pump to execute the instructions to thereby selectively pressurize the open and close control lines 80 and 84 and the open control chamber 78 and the close control chamber 82. In some exemplary embodiments, the ICV open control line 52 is coupled to the controller 56 and the open control line 80 such that the controller 56 can pressurize both control lines 52, 80 with a single control signal. Similarly, the ICV close control line 54 and the close control line 84 may both be pressurized with a single control signal from the controller 56.

A first seal member 92A is provided on the closure member 60 to engage the housing 62 and fluidly isolate the close control chamber 82 from the inlet chamber 66. A second seal member 92B is provided on the closure member 60 to fluidly isolate the open control chamber 78 from the outlet chamber 68. The seal members 92A, 92B define pressure surfaces 88 and 90 in open control chamber 78 and the close control chamber 82, respectively. As such, pressurization of the open and close control chambers 78, 82, e.g., with the controller 56, generates forces against the pressure surfaces 88, 90 that can move the closure member 60 within the housing 62. The first seal member 92A defines a first outer diameter OD1 of the closure member 60 where the first seal member 92A seals against a polished bore in the housing 62. Since pressure in the close control chamber 82 is applied against the first seal member 92A, the first outer diameter OD1 defines an effective surface area against which the pressure in the close control chamber 82 is applied to the closure member 60. A second outer diameter OD2 of the closure member 60 is defined by a maximum diameter of mating surface 72A, which establishes a seal with mating surface 72B when the closure member 60 is in the closed position. A third outer diameter OD3 is defined by a minimum diameter of the mating surface 74B, which establishes a seal with mating surface 74A of the closure member 60. A fourth outer diameter OD4 is defined by the second seal member 92B. The fourth outer diameter OD4 defines an effective surface area against which pressure in the open control chamber 78 may be applied to the closure member 60. In some embodiments, the fourth outer diameter OD4 may be equivalent to the first outer diameter OD1 to balance the forces applied the closure member 60 when the same absolute hydrostatic pressure is supplied to the open and close chambers 78, 82.

A biasing mechanism 96 is provided to bias the closure member 60 to the closed position as illustrated wherein the mating surfaces 72A, 72B are engaged with one another. In some exemplary embodiments, the biasing mechanism 96 includes a compression spring 98 coupled between the housing 62 and the closure member 60. The compression spring 98 is illustrated within the close control chamber 82 abutting the pressure surface 90. Other embodiments are contemplated were the compression spring 98 engages another shoulder (not shown) on the closure member 60.

When the closure member 60 is in the closed position, the fluid pressure in the chemical supply line 44, e.g., the fluid pressure of treatment fluids in the inlet chamber 66, is applied against the closure member 60, thereby generating a net force that maintains the closure member 60 in the closed position. The pressure in the inlet chamber 66 is applied against the first seal member 92A as well as the seal established by the mating surfaces 72A, 72B. Since the second outer diameter OD2 at the mating surface 72A is larger than the first outer diameter OD1 at the first seal member 92A, the pressure in the inlet chamber 66 generates a downward net force on the closure member 60 that maintains the closure member 60 in the closed position where mating surfaces 72A and 72 are engaged.

Figure 2B:
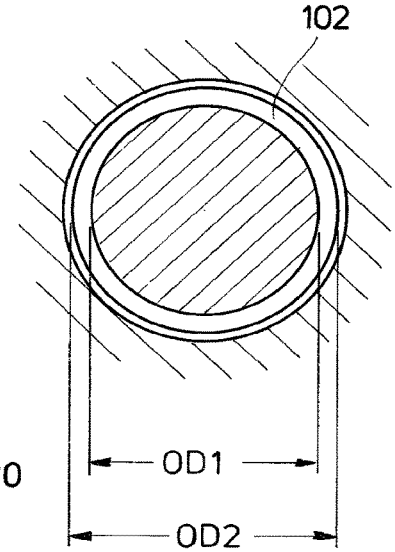
FIG. 2B is a schematic view of an effective net surface upon which pressure acts on a closure member when the chemical injection valve in the closed configuration to maintain the chemical injection valve in the closed configuration.

As illustrated in FIG. 2B, an equivalent differential surface 102 is defined by the difference between the outer diameters OD2 and OD1. The differential surface 102 is equivalent to a net surface on the closure member 60 upon which the pressure in the inlet chamber 66 acts when the closure member 60 is in the closed position to maintain the closure member 60 in the closed position, e.g., the differential surface 102 may be equivalent to the difference between the upward facing surfaces and the downward facing surfaces of the closure member 60 within the inlet chamber 66. As described in greater detail below, when the closure member 60 is in the open position, the pressure in the inlet chamber 66 is equalized with the pressure in the outlet chamber 68, and the pressure in the inlet and outlet chambers 66, 68 is applied to an equivalent differential surface 104 (see FIG. 3B).

The pressure in the inlet chamber 66 is based on the pressure in the chemical supply line 44, e.g., a chemical injection pressure, a hydrostatic pressure or a test pressure. Thus, when the closure member 60 is in the closed position, the pressure in the chemical supply line 44, the biasing mechanism 96 and any pressure in the close control line 84 applied against the pressure surface 90 all operate to urge the closure member 60 downward and maintain the closure member 60 in the closed position.

In order to prevent wellbore fluid inflow to the chemical supply line 44, the hydrostatic pressure in the chemical supply line 44 may be overbalanced with respect to the wellbore pressure at injection port 38A. The overbalanced pressure facilitates maintaining the integrity of the primary seal between first mating surfaces 72A, 72B when the auto-shut in chemical injection valve 12 is in the closed configuration. The hydrostatic pressure in the chemical supply line 44 may be balanced with open control line 80 and close control line 84 to facilitate closing of the chemical injection valve 12 in the event an injection pressure, the fluid pressure in the chemical supply line 44, is diminished, and thereby prevent the depletion of the chemical treatment fluid in the chemical supply line 44.

Figure 3A:
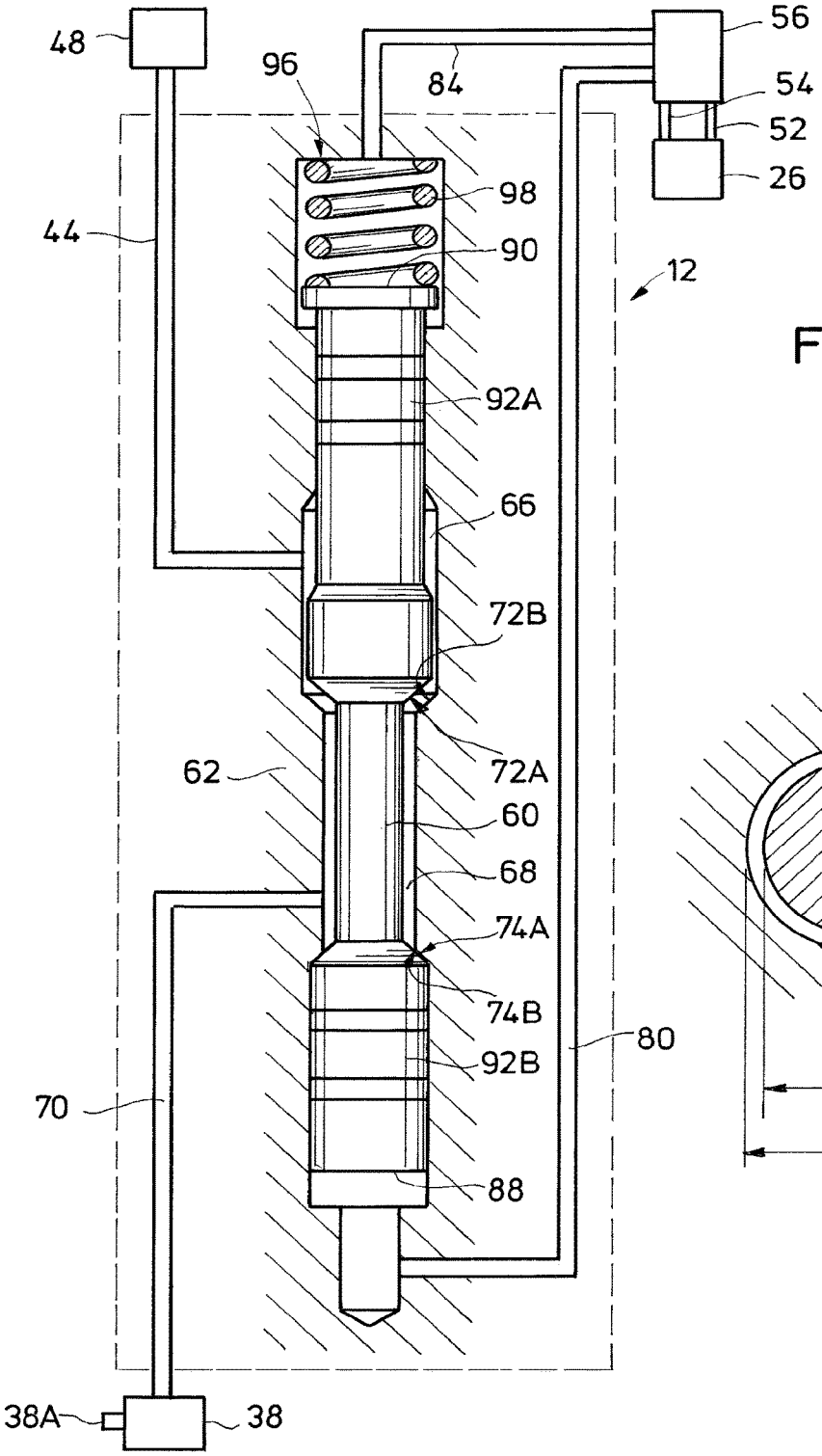
FIG. 3A is a partially cross-sectional side view of the auto-shut-in chemical injection valve in an open configuration.

FIG. 3A is a partially cross-sectional side view of the auto-shut-in chemical injection valve 12 in an open configuration. When the closure member 60 is in the open position within the housing 62, the first mating surfaces 72A, 72B are spaced from one another, and the second mating surfaces 74A, 74B are engaged with one another to establish a secondary seal therebetween. In this configuration, a treatment fluid may pass freely from pump 48, through the chemical supply line 44, into the inlet chamber 66 of the chemical injection valve 12, into the outlet chamber 68, into the output flow line 70, into the chemical injection mandrel 38 and through the injection port 38A.

When the auto-shut-in chemical injection valve 12 is in the open configuration, pressure is equalized between the inlet chamber 66 and the outlet chamber 68 as chemical treatment fluids from chemical supply line 44 are permitted flow between the first mating surfaces 72A, 72B. The equalized pressure is applied to the first seal member 92A and the secondary seal established by second mating 74A, 74B thereby generating a net force that maintains the closure member 60 in the open position.

Figure 3B:
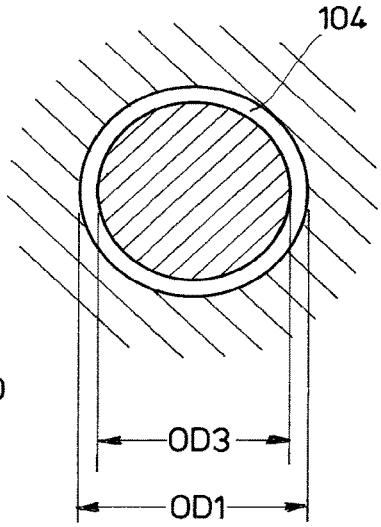
FIG. 3B is a schematic view of an effective net surface upon which pressure acts on the closure member when the chemical injection valve in the open configuration to maintain the chemical injection valve in the open configuration.

As illustrated in FIG. 3B, an equivalent differential surface 104 is defined by the difference between the outer diameters OD3 and OD1. The differential surface 104 is equivalent to a net surface on the closure member 60 upon which the pressure in the inlet chamber 66 and outlet chamber 68 acts when the closure member is in the open position to maintain the closure member 60 in the open position. For example, the differential surface 104 may be equivalent to a difference between the downward facing surfaces of the closure member 60 within the inlet and outlet chambers 66, 68, and the upward facing surfaces of the closure member 60 within the inlet and outlet chambers 66, 68. Since the first outer diameter OD1 is larger than third outer diameter OD3, pressure in the chambers 66, 68 will generate an upward net force on the closure member 60 to maintain the chemical injection valve 12 in the open configuration as long as the fluid pressure in the chemical supply line 44 is above a threshold pressure. In some exemplary embodiments, the threshold pressure may be greater than or equal to the hydrostatic pressure defined by the weight of a fluid column formed by a treatment chemical filling the chemical supply line 44 between the chemical injection valve 12 and the surface installation 46 (FIG. 1). The force applied by the biasing mechanism 96, e.g., the strength of the compression spring 98 may be selected to appropriately define the threshold pressure.

One skilled in the art will recognize that surfaces (not specifically identified) on the closure member 60 may act as pressure surfaces to which the hydrostatic or injection pressure in the chemical supply line 44 may be applied. In any event, the chemical injection pressure or hydrostatic pressure in the chemical supply line 44 applies a net force to the closure member 60 toward the open position when the closure member 60 is in the open position, and applies a net force toward the closed position when the closure member 60 is in the closed position.

Generally, to maintain the closure member 60 in the open position, the generally upward forces applied to surfaces 88, 104 are greater than downward forces applied by the biasing mechanism 96 together with the downward forces applied to pressure surface 90 and or a portion of the equivalent differential surface 102 by the fluid pressure in the chemical supply line 44. The closure member 60 may be moved to the closed position by increasing the downward force, e.g., by pressurizing close chamber 82 with controller 56, or alternatively by reducing the upward force, e.g., by reducing the chemical injection pressure in the chemical supply line 44 to a threshold pressure defined by the biasing mechanism 96 and hydrostatic pressure in the close control chamber 82.

Figure 4:
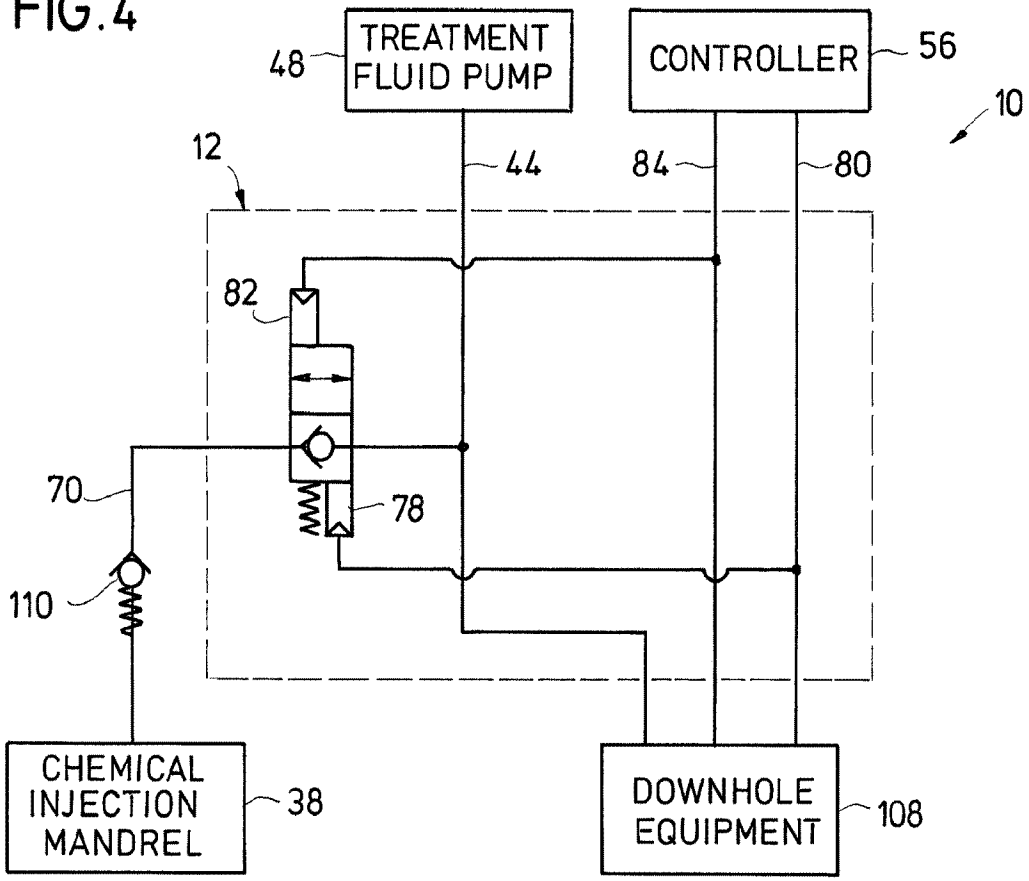
FIG. 4 is a schematic view of the chemical injection system of FIG. 1 illustrating a control line for opening the auto-shut-in chemical injection valve and a control line for closing the auto-shut-in chemical injection valve in addition to the chemical supply line.

FIG. 4 is a schematic view of the chemical injection system 10 illustrating the chemical supply line 44 and two distinct control lines, open control line 80 and close control line 84, for respectively opening and closing the auto-shut-in chemical injection valve 12. The open control line 80 extends from the controller 56 to open chamber 78 and the close control line extends to close chamber 82 as described above. The controller 56 is operable to selectively send a pressure signal to either chamber 78, 82 (through control lines 80, 84) to respectively open and close the chemical injection valve 12. A branch of the control lines 80, 84 as well as a branch of the chemical supply line 44 may also extend to additional downhole equipment 108. The additional downhole equipment 108 may include ICV 26 (FIG. 1), additional chemical injection valves 12, or other equipment recognized by those skilled in the art.

In this embodiment, the output flow line 70 includes a valve 110 therein. The valve 110 may be a check valve or a relief valve to permit fluid flow at a predefined pressure toward the chemical injection mandrel 38 and prohibit fluid flow toward the chemical injection valve 12. The valve 110 may provide a redundant seal, e.g., in addition to the primary seal formed by engaging first mating surfaces 72A, 72B (FIG. 2A), defined between the mandrel 38 and the chemical supply line 44. Generally, industry standards may demand a redundancy for a chemical injection valve 12 in a chemical injection system 10.

2. Additional Embodiments

Figure 5:
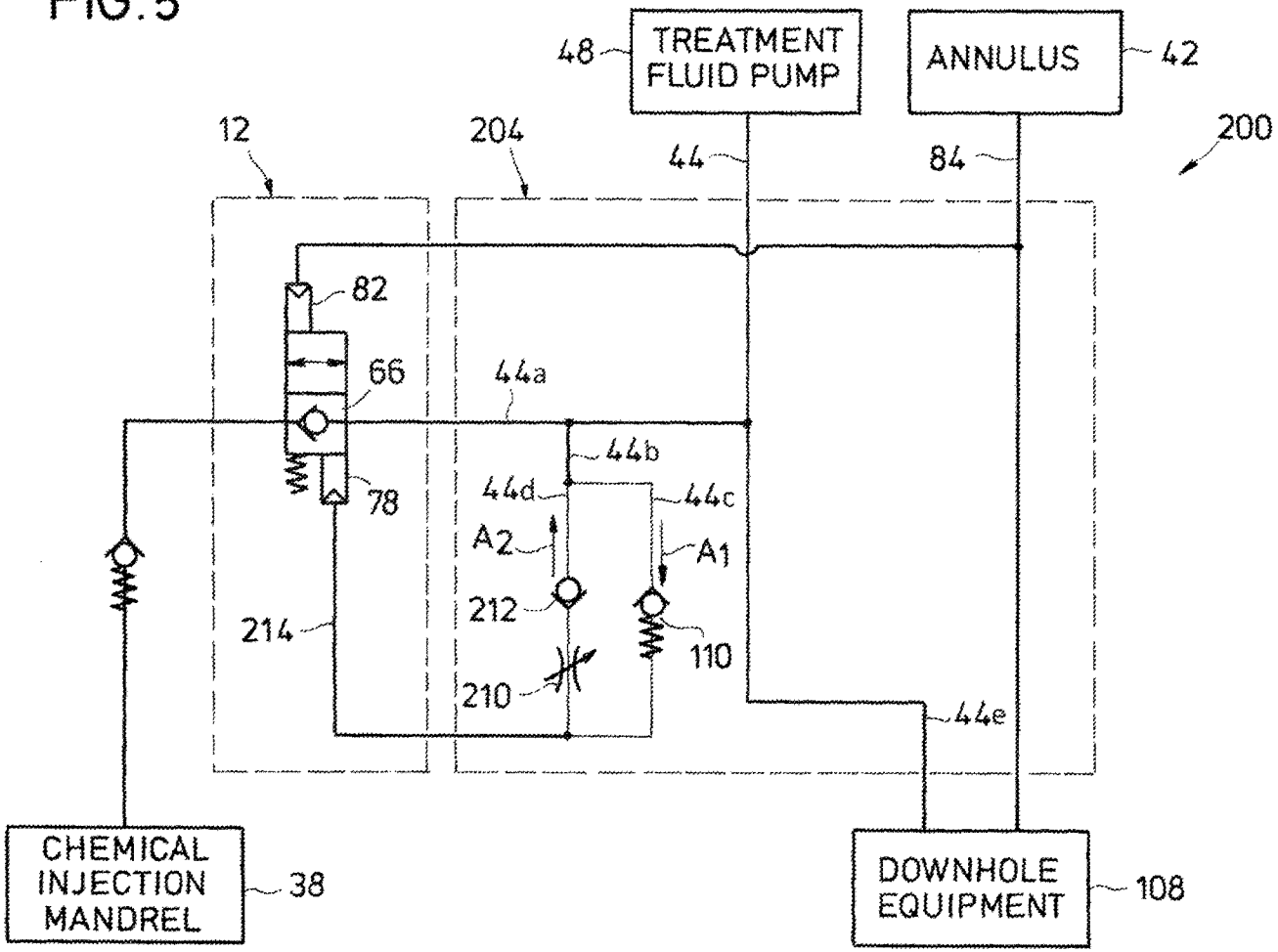
FIG. 5 is a schematic view of alternate chemical injection system including a control line for closing the auto-shut-in chemical injection valve and a chemical supply line that may be used to open the chemical injection valve.

FIG. 5 is a schematic view of an alternate chemical injection system 200 including close control line 84 for closing the auto-shut-in chemical injection valve 12 and chemical supply line 44 that may be employed to selectively open the chemical injection valve 12. Although the chemical injection system 200 is illustrated in connection with the additional downhole equipment 108, the alternate chemical injection system 200 may also have application in downhole environments where the chemical injection valve 12 is not used in conjunction with an ICV 26 (FIG. 1) or the additional downhole equipment 108. The arrangement of the injection system 200 does not require a distinct open control line 80 as employed in the system 10 (FIG. 4). By eliminating open control line 80 the chemical injection system 200 may realize savings in cost, complexity and maintenance as recognized by those skilled in the art.

One branch 44a of the chemical supply line 44 extends to the inlet chamber 66 of the chemical injection valve 12 as described above. Another branch 44b extends to a pressure storage mechanism 204. The pressure storage mechanism 204 may be constructed or housed within the manifold or housing 62 (FIG. 2A), and, as described above, the manifold or housing 62 may be constructed or housed within the mandrel 38 (FIG. 1). Thus, the internal components of chemical injection system 200 may be built and/or installed independently, within a housing 62 and/or within a mandrel 38. The pressure storage mechanism 204 includes an inlet branch 44c including a relief valve 110 that permits fluid flow only in the direction of arrow $A_1$. Another parallel exit branch 44d of the pressure storage mechanism 204 includes a flow restrictor 210 and a check valve 212 that permits fluid flow only in the direction of arrow $A_2$. The pressure storage mechanism 204 also includes a pressure storage flow line 214 extending to the open chamber 78 of the chemical injection valve 12. A branch of the close control line 84, as well as a branch 44e of the chemical supply line 44, may also extend to additional downhole equipment 108. As described above, the additional downhole equipment 108 may include ICV 26 (FIG. 1), additional chemical injection valves 12, or other equipment recognized by those skilled in the art.

The pressure storage mechanism 204 is operable to permit the chemical injection valve 12 to be opened with the pump 48 coupled to the chemical supply line 44. For example, the pump 48 may initially be operated to pump a treatment fluid to the inlet chamber 66 and simultaneously to the open chamber 78 through the relief valve 110 of the pressure storage mechanism 204. An initial pressure differential may thereby be established between the inlet chamber 66 and the open chamber 78 that is generally equal to a rating of the relief valve 110. For example, inlet chamber may be pressurized to a pressure of 5000 psi and the open chamber may be pressurized to a pressure of 4000 psi where the relief valve is rated at 1000 psi.

The initial pressure differential does not open the chemical injection valve 12 in some embodiments. However, pump 48 may then be operated appropriately to reduce pressure in the inlet chamber 66. The pressure in the open chamber 78 and the pressure storage flow line 214 will also be reduced as the treatment fluid is bled through the flow restrictor 210 and the check valve 212. The flow restrictor 210 permits the pressure to be reduced more quickly in the inlet chamber 66 than in open chamber 78. Thus, when the pressure in the inlet chamber 66 is reduced sufficiently, the pressure applied against the equivalent differential surface 102 (FIG. 2B) in the inlet chamber 66 together with the force of biasing mechanism 96 will no longer be sufficient to counteract the force of the pressure in the open chamber 78. In this manner, the chemical injection valve 12 may be moved to the open configuration by pump 48.

In this embodiment, the close control line 84 extends to the annulus 42 in the wellbore 18 (FIG. 1). An annulus pressure is transmitted through the close control line 84 to the close chamber 82. The annulus pressure is thus applied to the pressure surface 90 (FIG. 2A) thereby biasing the closure member 60 toward the closed position. In other embodiments, the close control line 84 may extend to the controller 56 as described above for selectively closing the chemical injection valve 12 or to a surface pump (not shown) at the surface installation (FIG. 1) that is dedicated to close the chemical injection valve 12. In some embodiments, the close control line 84 extends to a close control line 54 (FIG. 2A) of an ICV 26, such that the close control lines 54 and 84 may transmit a single close control signal to both the chemical injection valve 12 and the ICV 26.

3. Example Methods of Operation

Figure 6:
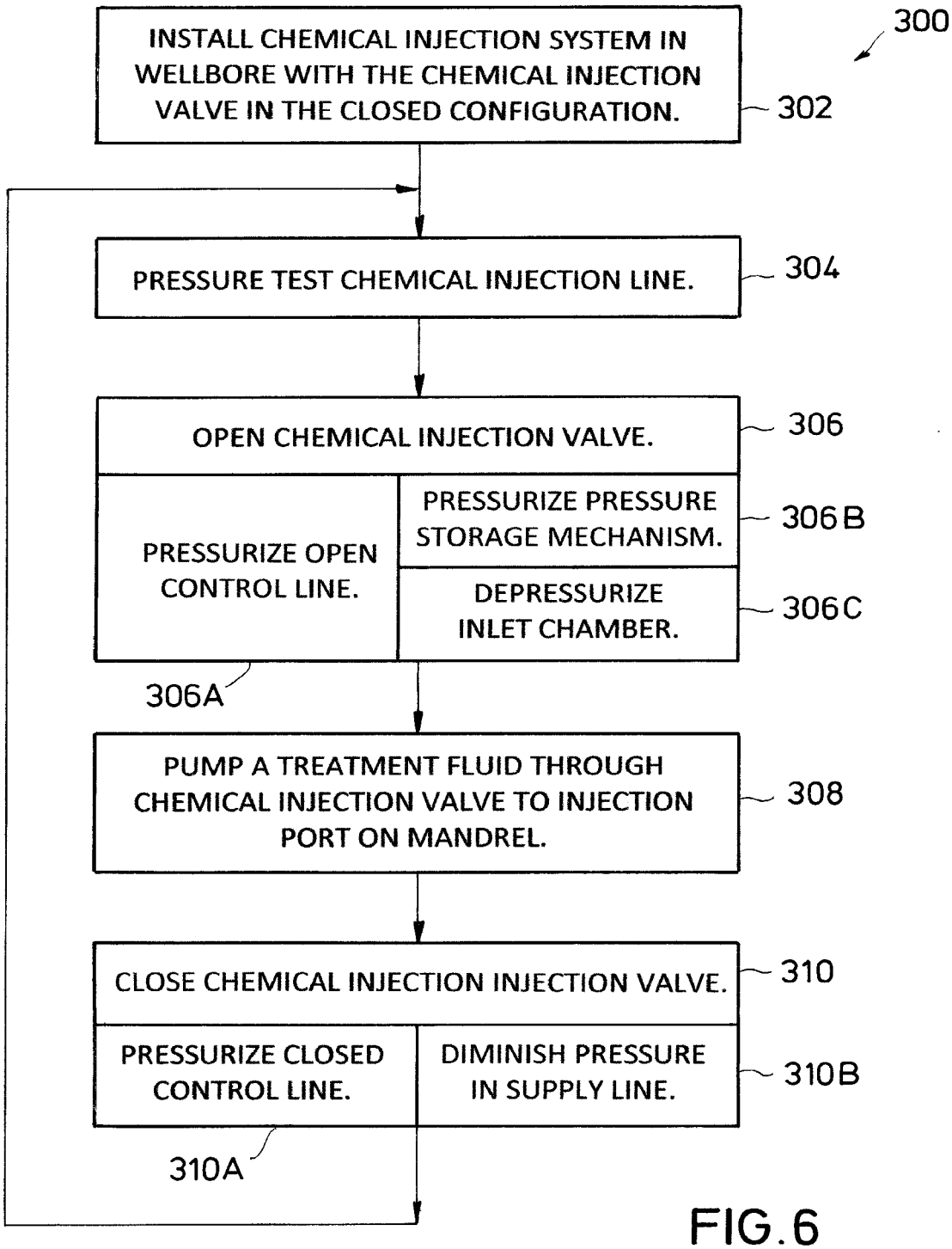
FIG. 6 is a flowchart illustrating an operational procedure for testing and operating a chemical injection system in accordance with one or more exemplary embodiments of the disclosure.

FIG. 6 is a flowchart illustrating an operational procedure 300 for testing and operating chemical injection systems 10 and 200 in accordance with one or more exemplary embodiments of the disclosure. With reference to FIG. 6 and FIGS. 1 through 3B, initially at step 302 the chemical injection system 10 or 200 is installed in wellbore 18 with the chemical injection valve 12 in a closed position. The chemical supply line 44 may be pressure tested at step 304. The pump 48 may be employed to pressurize the chemical supply line 44 to any desired test pressure. The test pressure will be applied against the equivalent differential surface 102 on the closure member 60 maintaining the closure member 60 in the closed position. The test pressure may then be relieved, and the procedure 300 may proceed to step 306 where the chemical injection valve 12 is opened so that chemical injection system 10 or 200 may be operated to provide a treatment chemical to the injection port 38A of the chemical injection mandrel 38.

At step 306, the chemical injection valve 12 may be opened by operating the controller 56 to provide a control signal by pressurizing open control line 80 (step 306A). The control signal pressurizes open chamber 78 and applies an upward force on pressure surface 88. The upward force is sufficient to overcome the downward net force applied on the closure member 60 by the biasing mechanism 96, and by hydrostatic pressure in the chemical supply line 44 against differential surface 102, and the hydrostatic pressure in close control chamber 82. Thus, the closure member 60 is moved to the open position where the first mating surfaces 72A and 72B are separated and the secondary seal is established by the engagement of the second mating surfaces 74A, 74B. Where the control line 52 of an ICV 26 is coupled to the open control line 80, pressurization of the control line 80 may simultaneously pressurize the control line 52 to open the ICV 26 as appreciated by those skilled in the art.

At step 306, the chemical injection valve 12 that is installed in chemical injection system 200 may be opened by initially pressurizing the pressure storage mechanism 204 and the inlet chamber 66 with pump (step 306B), and subsequently reducing the pressure in the inlet chamber 66 (step 306C). Where the pressure in the inlet chamber 66 is reduced sufficiently rapidly, e.g., before the pressure in the pressure storage mechanism 204 is bled off through the flow restrictor 210, a sufficient pressure differential will be established between the open chamber 78 and the inlet chamber 66 to open the chemical injection valve 12.

Next, at step 308, the pump 48 is operated to maintain a chemical injection pressure in the chemical supply line 44 and thereby pump a treatment fluid between the first mating surfaces 72A, 72B to the injection port 38A of the chemical injection mandrel 38. The chemical injection pressure in the chemical supply line 44 is applied to the equivalent differential surface 104, and maintains the closure member 60 in the open position. The pressure in the open chamber 78 may be bled off or reduced while the chemical injection pressure in the chemical supply line 44 is maintained.

At step 310 the closure member 60 is returned to the closed position by either operating the controller 56 to apply a pressure signal to close chamber 82 (step 310A) or by diminishing the pressure in the chemical supply line 44 (step 310B). Where the controller 56 is operated (step 310A), the close control line 84 and the close chamber 82 are pressurized to apply a pressure against the pressure surface 90. A downward force is thereby applied to pressure surface 90 to overcome the upward force applied by the chemical injection pressure in the chemical supply line 44. Where the chemical injection pressure in the control line 44 is diminished, the pump 48 may be discontinued (step 310B) until the chemical injection pressure in the chemical supply line 44 is reduced below a threshold where the pressure applied against equivalent differential surface 104 is no longer sufficient to overcome the downward forces applied by the biasing mechanism 96, and the fluid pressures applied to pressure surface 90. In some instances, the pressure in the chemical supply line 44 is inadvertently diminished due to equipment failure, clogged flow lines, etc. Where the pressure in the chemical supply line is reduced below the predetermined threshold, the chemical injection valve 12 will automatically close with no input from operators (not shown). In some embodiments, the predetermined threshold may be greater than or about equal to the hydrostatic pressure in the chemical injection line. Since the hydrostatic pressure in the chemical supply line 44 may be designed to be overbalanced against the wellbore pressure at injection port 38A, the bottomhole fluids will be isolated by the primary seal established by mating surfaces 72A, 72B. Thus, the hydrostatic pressure in the chemical supply line 44 may be maintained independently of any fluctuations of the bottom hole pressure. The biasing mechanism 96 and relative sizes of the equivalent differential surfaces 102, 104 will determine how much overbalance will be maintained in the hydrostatic pressure in the control line 44 relative to the hydrostatic pressure in the close control line 84.

Once the chemical injection valve 12 is closed, the procedure 300 may be returned to step 304 where additional pressure testing may be performed on the chemical supply line 44. Since the chemical injection valve 12 does not employ sacrificial burst discs to permit pressure testing, the chemical injection valve 12 may be maintained in the wellbore between pressure tests 304.

4. Aspects of the Disclosure

The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a downhole chemical injection system for positioning in a wellbore. The system includes a tubing string extending into the wellbore. A chemical injection mandrel is coupled within the tubing string, and includes an injection port in fluid communication with at least one of an interior of the tubing string and an exterior of the tubing string within the wellbore. A chemical supply line extends into the wellbore, and is operable to transport a treatment fluid from the surface location to the injection port. The system further includes an auto-shut-in chemical injection valve coupled within the chemical supply line and responsive to a fluid pressure in the chemical supply line below a predetermined threshold to move to a closed configuration to thereby obstruct flow of treatment fluid from the chemical supply line through the injection port.

In one or more exemplary embodiments, the chemical injection valve further comprises a closure member defining a first equivalent differential surface thereon, wherein the first equivalent differential surface is fluidly coupled to the chemical supply line when the chemical injection valve is in an open configuration such that the fluid pressure in the chemical supply line applied to the first equivalent differential surface generates a force on the closure member to urge the chemical injection valve toward the open configuration. In some embodiments, the closure member further defines a second equivalent differential surface thereon wherein the second equivalent differential surface is fluidly coupled to the chemical supply line when the chemical injection valve is in the closed configuration such that the fluid pressure in the chemical supply line applied to the second equivalent differential surface generates a force on the closure member to urge the chemical injection valve toward the closed configuration. The first equivalent differential surface may include a first mating surface, wherein the first mating surface engages a corresponding first mating surface of the chemical injection valve when the chemical injection valve is in the closed configuration. The first mating surface may be spaced from the corresponding first mating surface when the closure member is in the open position to permit fluid flow between the first mating surface and the corresponding first mating surface. In some exemplary embodiments, the second equivalent differential surface includes a second mating surface, wherein the second mating surface engages a corresponding second mating surface of the chemical injection valve when the chemical injection valve is in the open configuration and disengages the corresponding second mating surface when the chemical injection valve is in the closed configuration.

In some exemplary embodiments, the system further includes a relief valve coupled to an output flow line extending between the auto-shut-in chemical injection valve and the injection port. In some embodiments, the chemical injection valve further includes an open chamber and a close chamber, wherein pressurization of the open chamber and close chamber urges the chemical injection valve to the respective open and closed positions. The open chamber and close chamber may be fluidly coupled to a controller by respective open and close control lines, and wherein the controller may be selectively operable to pressurize the open and close control lines. In some embodiments, the close control line is fluidly coupled to an annulus defined in the wellbore about the tubing string.

In some embodiments, the system further includes a pressure storage mechanism operably coupled to the open chamber, the pressure storage mechanism operable to permit pressure to be reduced more quickly in an inlet chamber in which the second equivalent differential surface is defined than in the open chamber. In some embodiments, the pressure storage mechanism includes an inlet line and an outlet line with flow restrictor therein. In some embodiments, the inlet line and the outlet line are both fluidly coupled to the chemical supply line.

In another aspect, the disclosure is directed to a method of chemical injection in a wellbore. The method includes (a) installing a chemical injection valve at a downhole location in the wellbore between a chemical supply line and an injection port, wherein the chemical supply line extends to a surface installation, and wherein the injection port is fluidly coupled to at least one of an interior and an exterior of a tubing string within the wellbore, (b) transporting a treatment fluid to the injection port through the chemical supply line and chemical injection valve, and (c) closing the chemical injection valve in response to a diminishment of fluid pressure in the chemical supply line to below a predetermined threshold.

In one or more exemplary embodiments, the method further includes maintaining the chemical injection valve in an open configuration with the fluid pressure in the chemical supply line when the fluid pressure is above the predetermined threshold. In some embodiments, maintaining the chemical injection valve in the open configuration further includes applying the fluid pressure in the chemical supply line to a first mating surface defined on a closure member of the chemical injection valve to urge the chemical injection valve to an open configuration. Closing the chemical injection valve may further include engaging the first mating surface with a corresponding first mating surface of the chemical injection valve to isolate the first mating surface from the fluid pressure in the chemical supply line.

In some exemplary embodiments, the method further includes pressure testing the chemical supply line subsequent to closing the chemical injection valve by increasing the fluid pressure in the chemical supply line to a testing pressure. Pressure testing the chemical supply line may further include applying the fluid pressure to a closure member of the chemical injection valve to urge the chemical injection valve to a closed configuration. In some embodiments, the closure member includes an equivalent differential surface defined thereon, wherein the equivalent differential surface is equivalent to a net surface on the closure member upon which a pressure in an inlet chamber coupled to the chemical supply line acts when the closure member is in a closed position to maintain the closure member in the closed position.

In one or more exemplary embodiments, the method further includes opening the chemical injection valve and an interval control valve coupled to the chemical injection valve by simultaneously pressurizing respective control lines extending to both the chemical injection valve and the interval control valve.

In some embodiments, the method further includes opening the chemical injection valve by pressurizing the chemical supply line to charge a pressure storage mechanism operably coupled to a closure member of the chemical injection valve to urge the chemical injection valve to an open configuration, and subsequent to charging the pressure storage mechanism, reducing the fluid pressure in the chemical supply line to thereby reduce a force on the closure member urging the chemical injection valve to a closed configuration. Opening the chemical injection valve may further include bleeding pressure from the pressure storage mechanism through a flow restrictor coupled to the chemical supply line.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A downhole chemical injection system for positioning in a wellbore, the system comprising:

a tubing string extending into the wellbore;

a chemical injection mandrel coupled within the tubing string, the mandrel including an injection port in fluid communication with at least one of an interior of the tubing string and an exterior of the tubing string within the wellbore;

a chemical supply line extending into the wellbore, the chemical supply line operable to transport a treatment fluid from a surface location to the injection port;

an auto-shut-in chemical injection valve coupled within the chemical supply line and responsive to a fluid pressure in the chemical supply line below a predetermined threshold to move to a closed configuration to thereby obstruct flow of treatment fluid from the chemical supply line through the injection port;

an open chamber and a close chamber, wherein pressurization of the open chamber and close chamber urges the chemical injection valve to the respective open and closed positions;

open and close control lines respectively fluidly coupled to the open chamber and close chamber; and a controller operably coupled to the open and close control lines, wherein the controller is selectively operable to pressurize the open and close control lines.

2. The system of claim 1, wherein the chemical injection valve further comprises a closure member defining a first supply pressure surface thereon, wherein the first supply pressure surface is fluidly coupled to the chemical supply line when the chemical injection valve is in an open configuration such that the fluid pressure in the chemical supply line applied to the first supply pressure surface generates a force on the closure member to urge the chemical injection valve toward the open configuration.

3. The system of claim 2, wherein the closure member further defines a second supply pressure surface thereon, wherein the second supply pressure surface is fluidly coupled to the chemical supply line when the chemical injection valve is in the closed configuration such that the fluid pressure in the chemical supply line applied to the second supply pressure surface generates a force on the closure member to urge the chemical injection valve toward the closed configuration.

4. The system of claim 3, wherein the first supply pressure surface includes a first mating surface, wherein the first mating surface engages a corresponding first mating surface of the chemical injection valve when the chemical injection valve is in the closed configuration, and wherein the first mating surface is spaced from the corresponding first mating surface when the closure member is in the open position to permit fluid flow between the first mating surface and the corresponding first mating surface.

5. The system of claim 4, wherein the second supply pressure surface includes a second mating surface, wherein the second mating surface engages a corresponding second mating surface of the chemical injection valve when the chemical injection valve is in the open configuration and disengages the second corresponding second mating surface when the chemical injection valve is in the closed configuration.

6. The system of claim 1, further comprising a relief valve coupled to an output flow line extending between the auto-shut-in chemical injection valve and the injection port.

7. The system of claim 1, wherein the close control line is fluidly coupled to an annulus defined in the wellbore about the tubing string.

8. The system of claim 1, further comprising a pressure storage mechanism operably coupled to the open chamber, the pressure storage mechanism comprising an inlet branch and an outlet branch with a flow restrictor therein.

9. The system of claim 8, the wherein inlet branch and the outlet branch are both fluidly coupled to the chemical supply line.

10. A method of chemical injection in a wellbore, the method comprising:

installing a chemical injection valve at a downhole location in the wellbore between a chemical supply line and an injection port, wherein the chemical supply line extends to a surface installation, and wherein the injection port is fluidly coupled to at least one of an interior and an exterior of a tubing string within the wellbore;

transporting a treatment fluid to the injection port through the chemical supply line and chemical injection valve; and moving the chemical injection valve to a closed configuration in response to a diminishment of fluid pressure in the chemical supply line to below a predetermined threshold; and operating a controller to selectively pressurize open and close control lines extending respectively to respective open and close chambers, wherein pressurization of the open chamber urges the chemical injection valve to an open configuration and wherein pressurization of the close chamber urges the chemical injection valve to the closed configuration.

11. The method of claim 10, further comprising maintaining the chemical injection valve in the open configuration with the fluid pressure in the chemical supply line when the fluid pressure is above the predetermined threshold.

12. The method claim 11, wherein maintaining the chemical injection valve in the open configuration further comprises applying the fluid pressure in the chemical supply line to a first mating surface defined on a closure member of the chemical injection valve to urge the chemical injection valve to the open configuration.

13. The method of claim 12, wherein moving the chemical injection valve to the closed configuration in response to diminishment of fluid pressure in the chemical supply line further comprises engaging the first mating surface with a corresponding first mating surface of the chemical injection valve to isolate the first mating surface from the fluid pressure in the chemical supply line.

14. The method of claim 10, further comprising pressure testing the chemical supply line by increasing the fluid pressure in the chemical supply line to a testing pressure while the chemical injection valve is in the closed configuration.

15. The method of claim 14, wherein pressure testing the chemical supply line further comprises applying the fluid pressure to a closure member of the chemical injection valve to urge the closure member toward a closed position to thereby maintain the chemical injection valve in the closed configuration.

16. The method of claim 10, further comprising simultaneously pressurizing the open control line extending to the chemical injection valve and a control line extending to an interval control valve such that the chemical injection valve and the interval control valve may be opened.

17. The method of claim 10, further comprising moving the chemical injection valve to the open configuration by:

first pressurizing the chemical supply line to apply a force to a supply pressure surface of a closure member of the chemical injection valve urging the chemical injection valve toward the closed configuration and to charge a pressure storage mechanism operably coupled to the open chamber of the chemical injection valve such that charging the pressure storage mechanism applies a pressure to the open chamber to urge the chemical injection valve toward the open configuration, and subsequent to charging the pressure storage mechanism, reducing the fluid pressure in the chemical supply line to thereby reduce the force on the closure member urging the chemical injection valve to the closed configuration until the pressure applied to the open chamber moves the chemical injection valve to the open configuration.

18. The method of claim 17, further comprising bleeding pressure from the pressure storage mechanism through a flow restrictor coupled to the chemical supply line to permit pressure to be reduced more quickly on the supply pressure surface than in open chamber.

19. A downhole chemical injection system for positioning in a wellbore, the system comprising:

a tubing string extending into the wellbore;

a chemical injection mandrel coupled within the tubing string, the mandrel including an injection port in fluid communication with at least one of an interior of the tubing string and an exterior of the tubing string within the wellbore;

a chemical supply line extending into the wellbore, the chemical supply line operable to transport a treatment fluid from a surface location to the injection port;

an auto-shut-in chemical injection valve coupled within the chemical supply line and responsive to a fluid pressure in the chemical supply line below a predetermined threshold to move to a closed configuration to thereby obstruct flow of treatment fluid from the chemical supply line through the injection port;

wherein the chemical injection valve further comprises a closure member defining a first supply pressure surface thereon, wherein the first supply pressure surface is fluidly coupled to the chemical supply line when the chemical injection valve is in an open configuration such that the fluid pressure in the chemical supply line applied to the first supply pressure surface generates a force on the closure member to urge the chemical injection valve toward the open configuration wherein the closure member further defines a second supply pressure surface thereon, wherein the second supply pressure surface is fluidly coupled to the chemical supply line when the chemical injection valve is in the closed configuration such that the fluid pressure in the chemical supply line applied to the second supply pressure surface generates a force on the closure member to urge the chemical injection valve toward the closed configuration;

wherein the first supply pressure surface includes a first mating surface, wherein the first mating surface engages a corresponding first mating surface of the chemical injection valve when the chemical injection valve is in the closed configuration, and wherein the first mating surface is spaced from the corresponding first mating surface when the closure member is in the open position to permit fluid flow between the first mating surface and the corresponding first mating surface; and wherein the second supply pressure surface includes a second mating surface, wherein the second mating surface engages a corresponding second mating surface of the chemical injection valve when the chemical injection valve is in the open configuration and disengages the second corresponding second mating surface when the chemical injection valve is in the closed configuration.

* * * * *